US006802645B2

(12) United States Patent
Ludwig

(10) Patent No.: US 6,802,645 B2
(45) Date of Patent: Oct. 12, 2004

(54) ESCAPEMENT FOR TIMEKEEPER

(75) Inventor: Oechslin Ludwig, La Chaux-de-Fonds (CH)

(73) Assignee: Ulysse Nardin S.A., Le Locle (CH)

( * ) Notice: Subject to any disclaimer, the term of this patent is extended or adjusted under 35 U.S.C. 154(b) by 0 days.

(21) Appl. No.: 10/441,274

(22) Filed: May 20, 2003

(65) Prior Publication Data

US 2004/0013046 A1 Jan. 22, 2004

(30) Foreign Application Priority Data

May 28, 2002 (EP) ..... 02077092

(51) Int. Cl.[7] ..... G04B 15/00

(52) U.S. Cl. ..... 368/127; 368/129; 74/1.5; 74/84 R; 74/437

(58) Field of Search ..... 368/124, 125, 368/129–132, 169; 74/1.5, 84 R, 435, 437

(56) References Cited

U.S. PATENT DOCUMENTS

| | | | | |
|---|---|---|---|---|
| 2,354,020 A | * | 7/1944 | Honger | 368/124 |
| 2,977,750 A | * | 4/1961 | Biemiller et al. | 368/130 |
| 3,143,848 A | * | 8/1964 | Biemiller et al. | 368/130 |
| 3,845,616 A | * | 11/1974 | Jeanmairet et al. | 368/124 |
| 6,301,981 B1 | * | 10/2001 | Oechslin | 74/1.5 |
| 6,708,576 B2 | * | 3/2004 | Oechslin | 74/1.5 |

FOREIGN PATENT DOCUMENTS

| | | |
|---|---|---|
| EP | 1 041 459 A1 | 10/2000 |
| EP | 1 221 637 A1 | 7/2002 |

* cited by examiner

*Primary Examiner*—Vit W. Miska
(74) *Attorney, Agent, or Firm*—Sughrue Mion, PLLC

(57) ABSTRACT

The escapement (1) arranged between a motor gear train and a roller (2) to which is attached a sprung balance of a timekeeper, the balance being able to describe an arc of free oscillation and to receive oscillation maintaining impulses, this escapement including first (3) and second (4) toothed wheels meshing with each other, one of these wheels being driven by the motor gear train and a rocking member (5) having:

Figure 1:
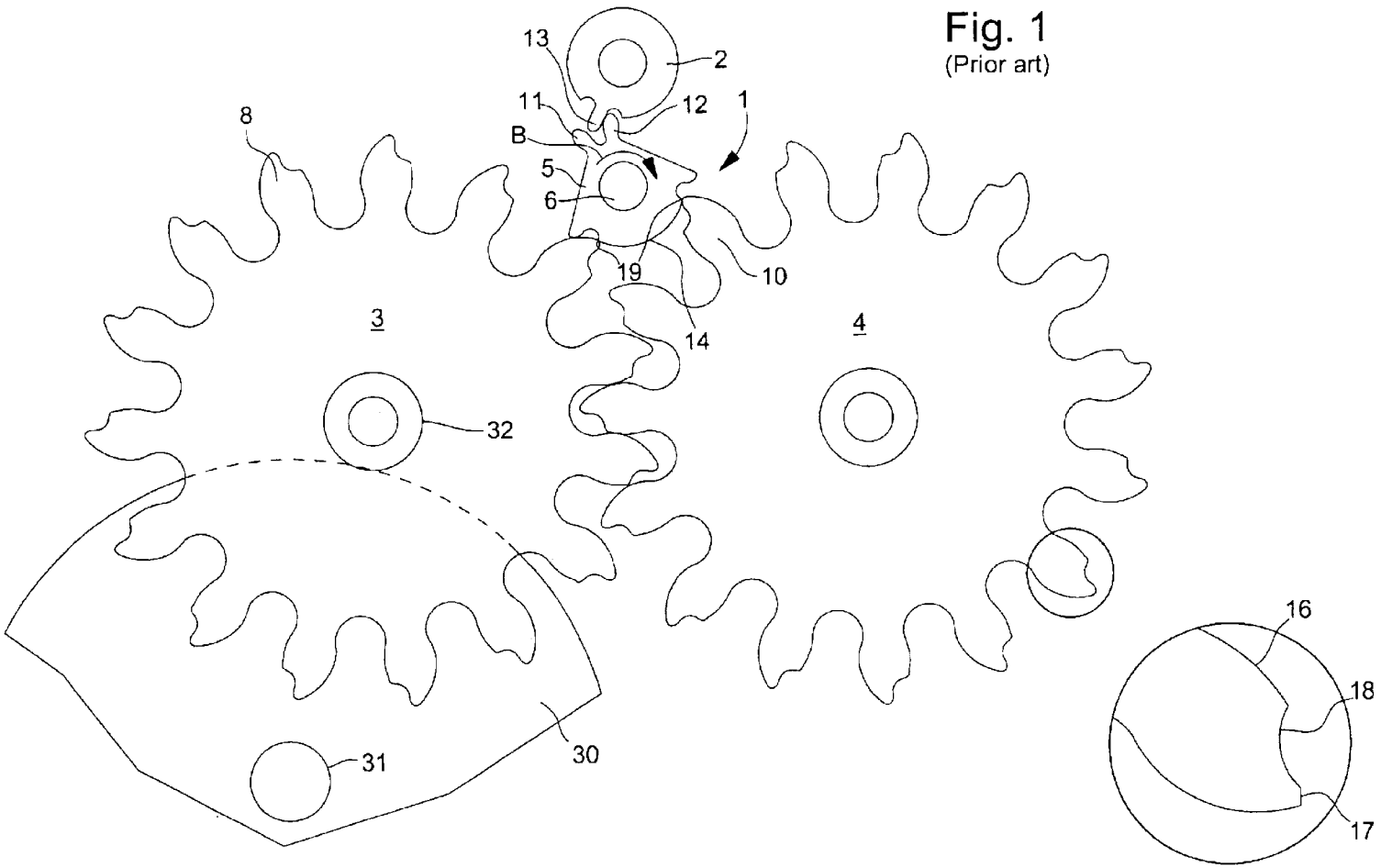
Fig. 1 (Prior art)

first (41) and second (42) contact means able to receive impulses generated alternately by the first (3) and second (4) wheels, impulse means (11, 12) capable of co-operating with the roller (2) to transmit said impulses to said roller to drive it in rotation and to maintain the oscillations of the balance, and first (43) and second (44) blocking means for alternately blocking said first (3) and second (4) wheels after each impulse transmitted by said impulse means to said roller, said first and second contact means and said first and second blocking means being arranged at the periphery of the rocking member in regions remote from each other.

7 Claims, 7 Drawing Sheets

ESCAPEMENT FOR TIMEKEEPER

The present invention relates to an escapement arranged between a motor gear train and a roller to which there is attached the balance of a timekeeper, the balance being able to describe an arc of free oscillation and to receive oscillation maintaining impulses, this escapement including first and second toothed wheels meshing with each other, one of these wheels being driven by the gear train.

The Applicant of the present invention has already proposed an escapement that partly answers the definition that has just been given and a description of which is given in European Patent document No. 01200043.6, incorporated herein by reference. This document describes an escapement shown in FIG. 1, arranged, as is usual, between a gear train and a roller 2 supporting a sprung balance of a timekeeper. The sprung balance, not shown in the Figure, is able, as is known, to move through an arc of free oscillation and is arranged to receive impulses for maintaining these oscillations. By definition, the gear train, also called the train, is the set of wheels and pinions which, from a barrel, transmits the driving force to an escapement wheel. In FIG. 1, the gear train is represented by its last wheel 30, associated with pinion 31. Wheel 30 drives a first escapement wheel 3 via pinion 32 which is fixed thereto. First wheel 3 meshes with a second wheel 4. Wheels 3 and 4 have the same diameter and the same number of teeth.

The escapement also includes a rocking member 5 able to receive impulses generated alternatively by the first and second escapement wheels 3 and 4. Rocking member 5, in turn, transmits the impulses received to roller 2 to drive it in rotation so as to maintain the oscillations of the sprung balance fixed to said roller 2. Moreover, the rocking member is arranged to block alternately the first and second escapement wheels 3 and 4, after each impulse has been transmitted to roller 2.

Rocking member 5 fitted to the escapement is supported by an arbour 6 freely pivoting in a plate (not shown) comprised in the timekeeper. This rocking member 5 has a substantially triangular shape. A first apex of the rocking member defines an edge 19 on which a tooth 8 of first wheel 3 can rest to subject rocking member 5 to an impulse in a first direction. A second apex of the rocking member defines another edge 19 on which a tooth 10 of the second wheel 4 can rest to subject rocking member 5 to an impulse in a second direction B, opposite to the first direction. Edges 19 of the rocking member are connected by a rim 14 allowing first 3 and second 4 wheels to be blocked alternately, in proximity to the edges, after each transmitted impulse. Finally, a third apex of rocking member 5 comprises two teeth 11 and 12 capable of meshing with a tooth 13 of roller 2.

Each of teeth 8, 10 of wheels 3 and 4 has a front flank 16 comprising a first curved summit cut out portion 17 capable of abutting against rim 14 of the rocking member to block one of the wheels, and a second cut out portion 18 in the shape of an arc of circle, following the first cut out portion, capable of abutting against one of edges 19 to drive rocking member 5 in rotation.

It is an object of the present invention, which takes up the features disclosed in the aforecited document, namely two wheels meshing with one another, one of the wheels being driven by the gear train, to provide a timekeeper escapement having improved chronometric performances.

For this purpose, the escapement of the present invention thus further includes a rocking member having:

first and second contact means able to receive impulses generated alternately by the first and second wheels, impulse means capable of co-operating with the roller to transmit said impulses to said roller to drive it in rotation and to maintain the oscillations of the balance, and first and second blocking means for blocking alternately said first and second wheels after each impulse transmitted by said impulse means to said roller, said first and second contact means and said first and second blocking means being arranged at the periphery of the rocking member in regions remote from each other.

According to a preferred embodiment of the invention, this rocking member is supported by an arbour pivoting freely in a plate of the timekeeper and the impulse means comprise first and second teeth capable of meshing with a tooth of the roller. It advantageously has a substantially symmetrical shape with respect to an axis passing between said first and second teeth of the rocking member and through the centre of the arbour, wherein:

the first and second contact means are arranged symmetrically with respect to said axis, and the first and second blocking means are arranged symmetrically with respect to said axis.

Thus, the rocking member of the invention not only allows the angle of lift to be reduced, which allows the chronometric performance to be improved, but also the impulse speed to be increased by selecting the leverage. Indeed, the introduction, in the present invention, of a rocking member comprising contact means (and associated impulse) and blocking means separated from and set apart from each other and co-operating with a tooth of the other wheel allows:

the number of teeth of the escapement wheels to be increased, the distance between the centre of the roller and the rocking member to be varied, and the angle of attack of one tooth of the first wheel or respectively the second wheel on respectively the first and second contact means to be optimised, at the time of an impulse.

As a result, on the one hand, the peripheral speed of the rocking member impulse means can be selected so as to be greater than that of the contact means and, on the other hand, the force transmitted by the teeth of the first and second escapement wheels on the rocking member is substantially perpendicular to the radius passing through the rotational axis of the rocking member and the point of contact of the teeth on the rocking member, which allows maximum transmission of the drive torque.

The invention will now be explained in detail hereinafter via an embodiment given by way of example, this embodiment being illustrated by the annexed drawings, in which:

FIG. 1, which has already been described, is a plan view of the escapement according to the prior art;

FIGS. 2 to 7 are plan views of the escapement according to the invention shown at six different stages describing one complete oscillation of the balance.

FIGS. 2 to 7 are plan views of six successive phases of the escapement of the invention, these phases covering one complete oscillation of the sprung balance. The escapement shown in these successive Figures differs from the escapement of the prior art in the structure of the rocking member 5 used as well as in the shape of teeth 8 and 10 of escapement wheels 3 and 4. The other elements, common to the two escapements, have already been described in FIG. 1.

Figure 2:
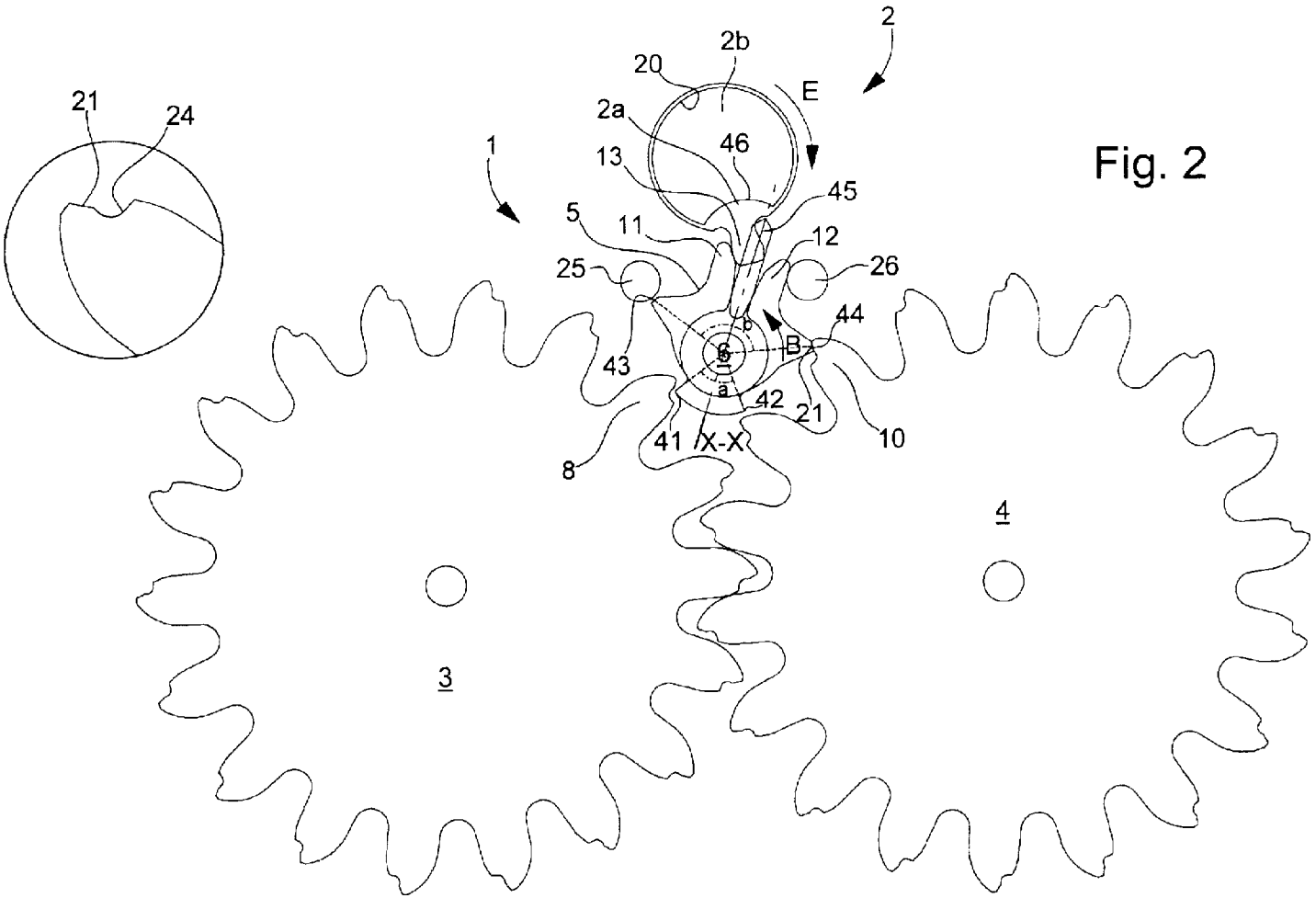

As FIG. 2 shows, rocking member 5 fitted to the escapement according to the invention is supported by an arbour 6 freely pivoting in a plate (not shown) of the timekeeper. This rocking member 5 includes first and second contact means respectively formed by first 41 and second 42 edges able to receive impulses generated alternately by the first 3 and second 4 wheels. It also includes impulse means comprising first and second teeth 11 and 12 capable of meshing with a tooth 13 of a roller 2 for transmitting these impulses to the roller to drive it in rotation and to maintain the oscillations of the balance.

It will be noted in this regard that roller 2 includes a lower plate 2*a* provided with tooth 13 and an upper plate 2*b* having a substantially smaller diameter provided with a notch 46 in the shape of an arc of circle opening onto tooth 13 the function of which will be explained hereinafter.

It further includes first and second blocking means formed by first 43 and second 44 blocking faces for alternately blocking the first 3 and second 4 wheels after each transmitted impulse. It is to be noted that the first 41 and second 42 edges and the first 43 and second 44 blocking faces are arranged at the periphery of rocking member 5 in regions remote from each other.

This rocking member 5 preferably has a substantially symmetrical shape with respect to an axis (X—X) passing between the first and second teeth 11 and 12 of the rocking member and through the centre of arbour 6. The first and second contact means are arranged symmetrically with respect to this axis (X—X) as well as the first and second blocking means.

It is to be noted that the angle (a) formed by the segment connecting the first contact means to the centre of the arbour and the segment connecting the second contact means to the centre of the arbour, is an acute angle preferably comprised between 50° and 70°. This angle (a), shown in FIG. 2, is advantageously equal to 60°.

It is also to be noted that the angle (b) formed by the segment connecting the first blocking means to the centre of the arbour and the segment connecting the second blocking means to the centre of the arbour, is an obtuse angle preferably comprised between 130° and 170°. This angle (b), shown in FIG. 3, is advantageously equal to 155°.

Figure 3:
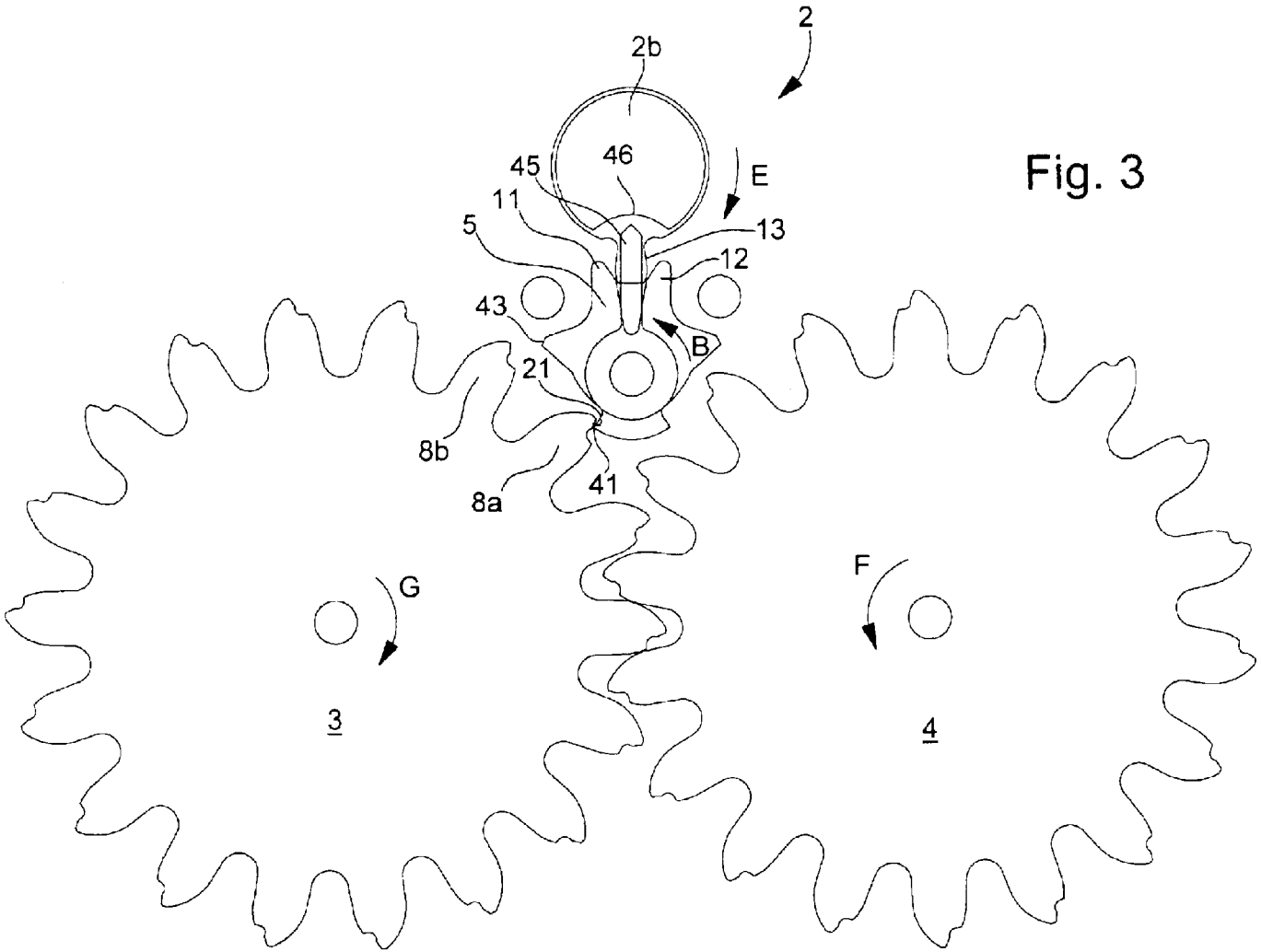

The first edge 41 forming the first contact means, co-operates with the end of a tooth 8 of the first wheel 3 to subject rocking member 5 to an impulse in a first direction (B) (see FIG. 3). The second edge 42 forming the second contact means, co-operates with the end of a tooth 10 of the second wheel 4 to subject rocking member 5 to an impulse in a second direction (A), opposite to the first direction (B) (see FIG. 7).

Figure 4:
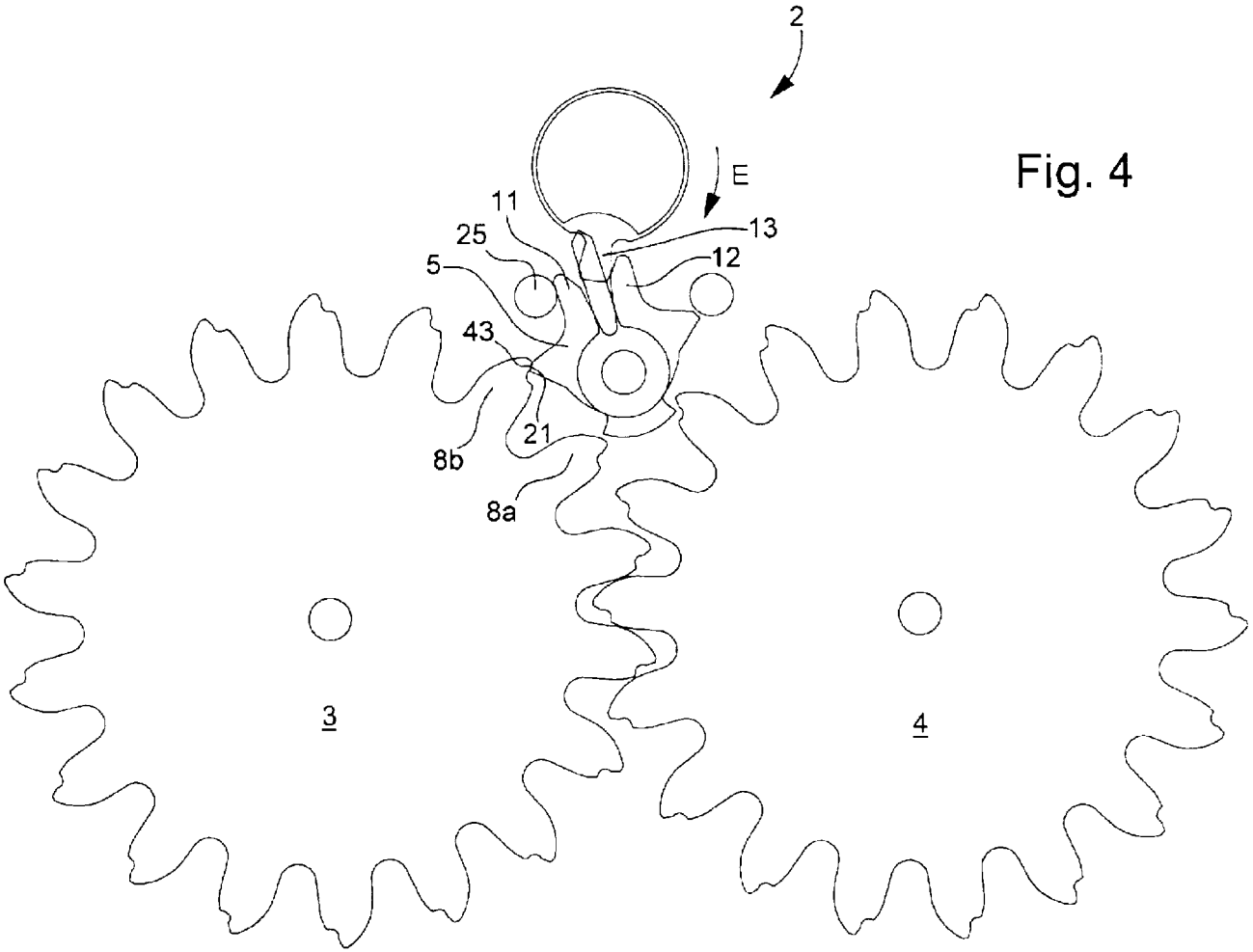

The first blocking face 43 co-operates with the end of a tooth 8 of wheel 3, next to tooth 8 that was previously used to subject the rocking member to an impulse in direction B, to block the rocking member (see FIG. 4). The second blocking face 44 co-operates with the end of a tooth 10 of wheel 4, next to tooth 10 that was previously used to subject the rocking member to an impulse in direction A, to block the rocking member.

It will also be observed that each of teeth 8,10 of respectively first 3 and second 4 wheels has a front flank 16 comprising a curved cut out portion 21 capable of co-operating respectively with the first 43 and second 44 blocking faces of the rocking member to block one of the wheels, and also capable of abutting respectively against the first 41 and second 42 edges of the rocking member to drive the rocking member in rotation.

Since it is important to avoid rocking member 5 overbanking (due for example to a shock) during the travel of the free oscillation arc of the balance and thus of roller 2 to which it is attached, there is provided a small tongue 45 preferably having one end ending in a point, placed in a parallel plane to that into which teeth 11 and 12 of the rocking member extend. Thus, during the free oscillation arc, small tongue 45 prevent rocking member 5 overbanking for example in the event of a shock by the latter being blocked at the periphery 20 of upper plate 2*b*.

Finally, it will be understood that it is important to limit the angular excursion of rocking member 5. Two pins 25 and 26, driven into the timekeeper plate, will be used for this purpose. Teeth 11 and 12 of rocking member 5 abut against the pins as shown in FIGS. 2 and 4, thus limiting the excursion of the rocking member.

As a preferred embodiment of the new escapement has been described hereinbefore as well as the functions fulfilled by the various parts forming it, its actual operating mode will now be reviewed by describing one complete working cycle. FIGS. 2 to 7, which show six important phases of this cycle, will be examined in turn.

First Phase (FIG. 2)

The mechanism is stopped. The second escapement wheel 4 is blocked since the curved cut out portion 21 of its tooth 10 is in contact with the second blocking face 44 of rocking member 5. The angular excursion of rocking member 5 is at the end of its travel since its tooth 12 is stopped against pin 26. At this moment the sprung balance is close to the end of oscillation (arrow E) or close to the end of the second vibration of this oscillation. Tooth 13 of plate 2 enters into contact with tooth 11 of rocking member 5 and will drive said rocking member in the direction of arrow B. This is a rocking member release phase where, on the one hand tooth 12 is driven so as to move away from pin 26 and, on the other hand, the second rocking member blocking face 44 can move aside curved cut out portion 21 of tooth 10.

Second Phase (FIG. 3)

Rocking member 5 continues its travel in the direction of arrow B, driven as it is by roller 2. At this moment, tooth 13 of the roller is totally engaged-between the two teeth 11 and 12 of rocking member 5. It will be noted that notch 46 of upper plate 2*b* allows, in this position, the passage of small tongue 45 and thus the rotation of rocking member 5. Curved cut out portion 21 of tooth 8*a* of the first wheel enters into contact with the first edge 41 of the rocking member. Escapement wheel 4 is then driven in the direction of arrow F via escapement wheel 3, which rotates in the direction of arrow G driven as it is in turn by the gear train the last element 30 of which is shown in FIG. 1. This is an impulse phase that moves the roller in the direction of arrow E and causes the rocking member to rotate in the direction of arrow B until the first rocking member blocking face 43 meets the curved cut out portion of tooth 8*b* of the first escapement wheel, next to tooth 8*a* in the opposite rotational direction of wheel 3.

Third Phase (FIG. 4)

When tooth 13 of roller 2 leaves tooth 12 of the rocking member, the first rocking member blocking face 43 abuts against the curved cut out portion 21 of the neighbouring tooth 8*b* of the first escapement wheel 3 thus blocking the first and second wheels. From this moment roller 2 begins a second oscillation in the direction of arrow E. The rocking member is then held by tooth 11, which abuts against pin 25.

Figure 5:
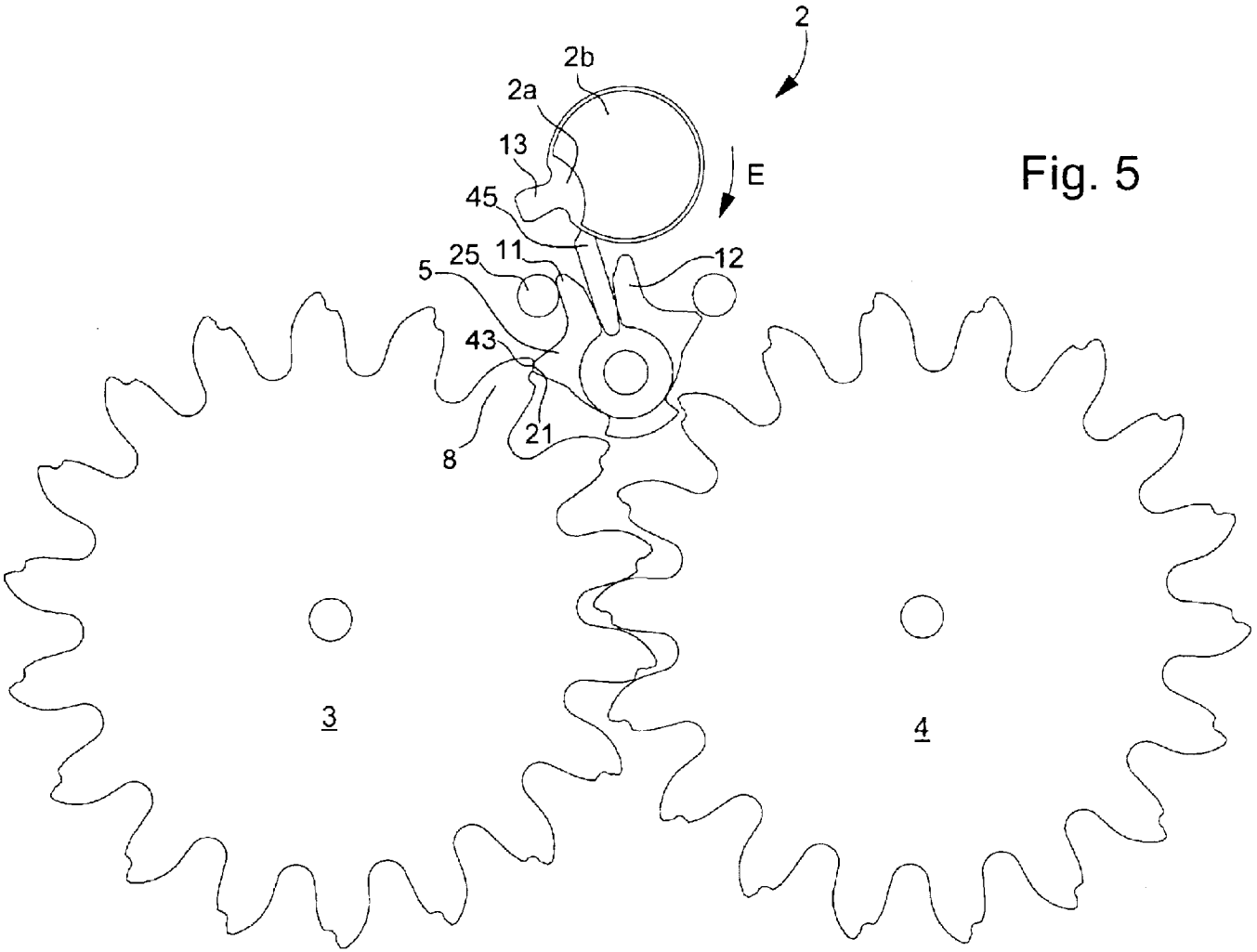

Fourth Phase (FIG. 5)

The situation of rocking member 5 is the same as that described hereinbefore with the only difference that small tongue 45 prevents any overbanking. Roller 2 continues to rotate in the direction of arrow E and covers the first vibration of its second free oscillation. Rocking member 5 and the first and second wheels 3 and 4 are still blocked.

Figure 6:
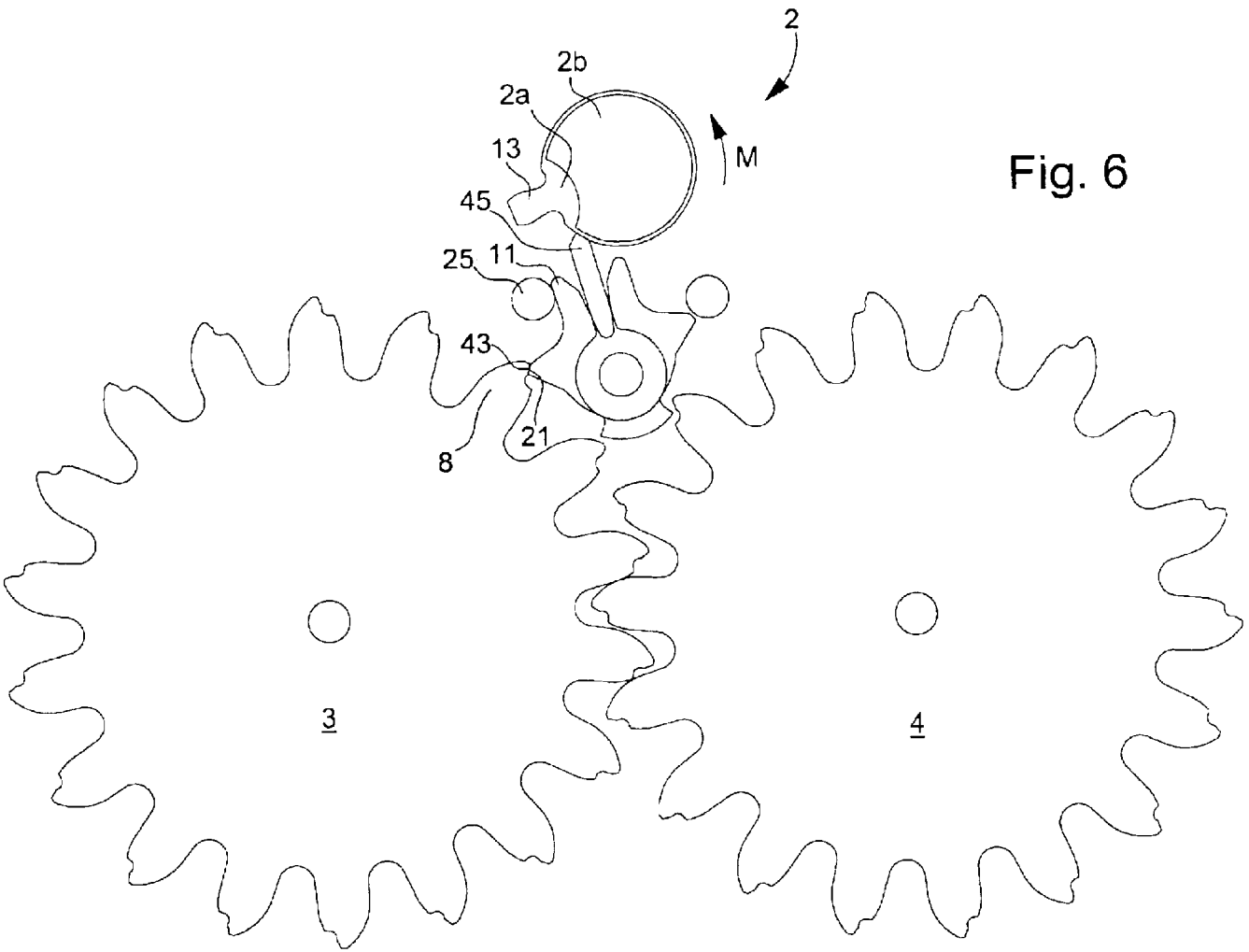

Fifth Phase (FIG. 6)

After having travelled through its first vibration, roller 2 returns in the opposite direction shown by arrow M and travels through the second vibration of its second free oscillation. Rocking member 5 still blocks the first and second wheels and is still prevented from overbanking owing to small tongue 45.

Figure 7:
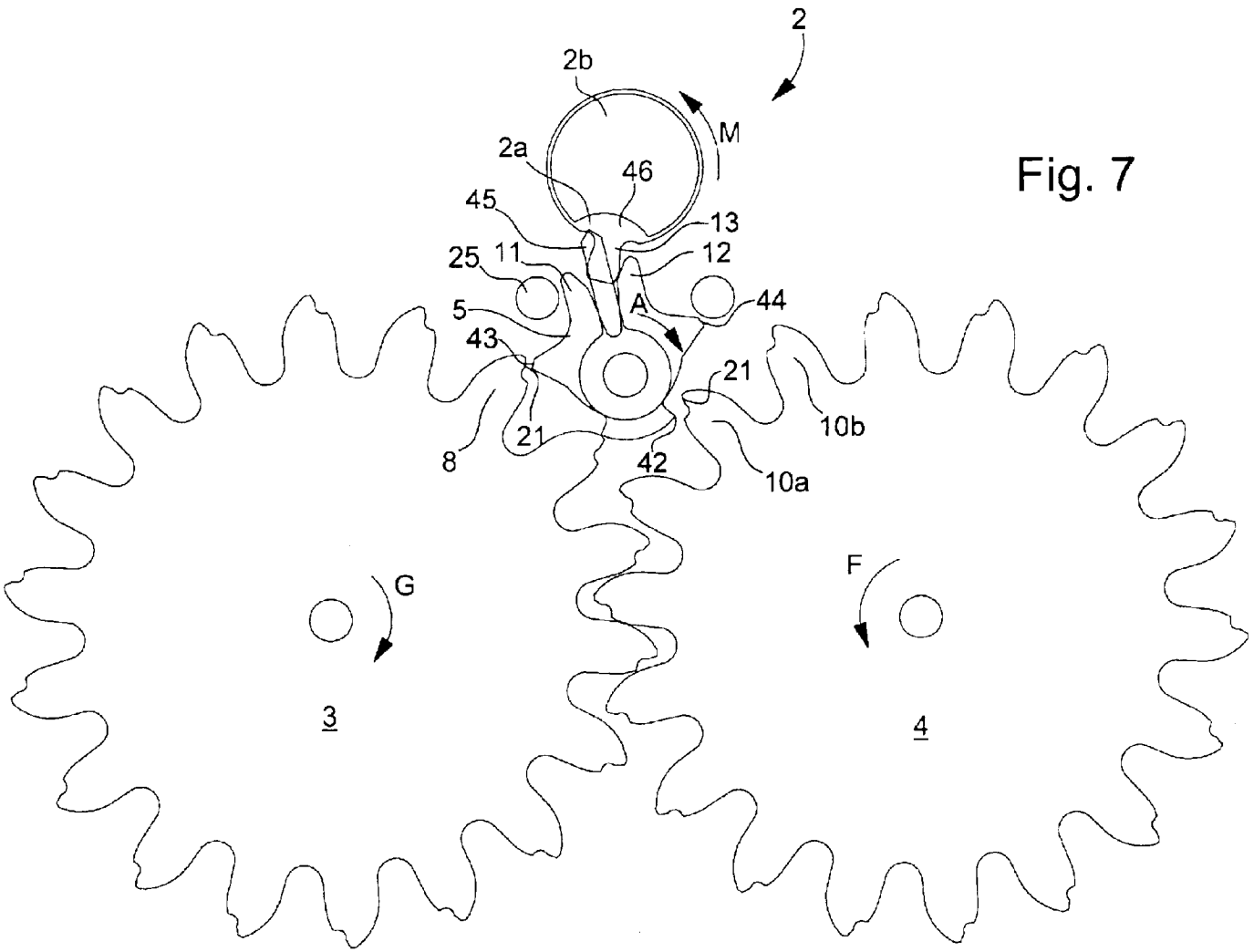

Sixth Phase (FIG. 7)

Tooth 13 of roller 2 enters into contact with tooth 12 of rocking member 5, which will drive the latter in the direction of arrow A. We are in a similar situation here to that illustrated by FIG. 1, i.e. at the beginning of a new release phase where, on the one hand tooth 11 is driven so as to move away from pin 25 and, on the other hand the first rocking member blocking face 43 can be moved aside curved cut out portion 21 of tooth 8 of first wheel 3 and which will allow 10*a* of second wheel 4 to abut on the second edge 42 of rocking member 5 to move roller 2 again. From this sixth phase a new cycle similar to that which has been described starts again, the next blockage acting on second escapement wheel 4 via wheel 10*b*, next to wheel 10*a* in the opposite rotational direction of wheel 4, on second rocking member blocking face 44.

Final Considerations

It will be noted that the first and second escapement wheels have a structure allowing more teeth to be arranged at their periphery, thus the torque necessary to drive the barrel is smaller and thus the energy consumed is lower.

What is claimed is:

1. An escapement arranged between a motor gear train and a roller to which is attached a sprung balance of a timekeeper, the balance being able to describe an arc of free oscillation and to receive oscillation maintaining impulses, this escapement including first and second toothed wheels meshing with each other, one of these wheels being driven by the motor gear train and a rocking member comprising:

first and second contact means able to receive impulses generated alternately by the first and second wheels, impulse means capable of co-operating with the roller to transmit said impulses to said roller to drive it in rotation and to maintain the oscillations of the balance, and first and second blocking means for alternately blocking said first and second wheels after each impulse transmitted by said impulse means to said roller, said first and second contact means and said first and second blocking means being arranged at the periphery of the rocking member in regions remote from each other.

2. The escapement according to claim 1, wherein the rocking member is supported by an arbour pivoting freely in a plate of the timekeeper, wherein said impulse means include first and second teeth capable of meshing with a tooth of the roller, wherein said rocking member has a substantially symmetrical shape with respect to an axis passing between said first and second teeth of the rocking member and through the centre of the arbour, wherein the first and second contact means are arranged symmetrically with respect to said axis, and the first and second blocking means are arranged symmetrically with respect to said axis.

3. The escapement according to claim 1, wherein the first contact means co-operate with an end of a tooth of the first wheel to subject the rocking member to an impulse in a first direction, the second contact means co-operate with an end of a tooth of the second wheel to subject the rocking member to an impulse in a second direction, opposite to the first direction, and the first and second blocking means co-operate with an end of a neighbouring tooth respectively of the first and second wheels to block the rocking member.

4. The escapement according to claim 1, wherein the first and second contact means are formed respectively by first and second edges and wherein the first and second blocking means are formed respectively by first and second blocking faces.

5. The escapement according to claim 4, wherein each of the teeth respectively of the first and second wheels has a front flank including a curved cut out portion capable of abutting respectively against the first and second blocking faces of the rocking member to block one of said wheels, and also capable of abutting respectively against the first and second edges of the rocking member to drive the rocking member in rotation.

6. The escapement according to claim 2, wherein a first segment connecting the first contact means and the centre of the arbour and a second segment connecting the second contact means and the centre of the arbour form an acute angle preferably comprised between 50° and 70°.

7. The escapement according to claim 2, wherein a first segment connecting the first blocking means and the centre of the arbour and a second segment connecting the second blocking means and the centre of the arbour form an obtuse angle preferably comprised between 130° and 170°.

* * * * *